US006071680A

United States Patent [19]

Bourdelais et al.

[11] Patent Number: 6,071,680

[45] Date of Patent: Jun. 6, 2000

[54] REFLECTIVE PHOTOGRAPHIC DISPLAY MATERIAL WITH VOIDED POLYESTER LAYER

[75] Inventors: Robert P. Bourdelais, Pittsford; Alphonse D. Camp, Rochester; Thomas M. Laney; Peter T. Aylward, both of Hilton, all of N.Y.

[73] Assignee: Eastman Kodak Company, Rochester, N.Y.

[21] Appl. No.: 09/217,754

[22] Filed: Dec. 21, 1998

[51] Int. Cl.[7] ..... G03C 1/795; G03C 1/765; G03C 1/93

[52] U.S. Cl. ..... 430/496; 430/510; 430/527; 430/534; 428/315.5; 428/315.7

[58] Field of Search ..... 430/533, 534, 430/496, 527, 510, 363, 494; 428/315.5, 315.7

[56] References Cited

U.S. PATENT DOCUMENTS

| | | | |
|---|---|---|---|
| 4,187,113 | 2/1980 | Mathews et al. | 430/533 |
| 4,701,369 | 10/1987 | Duncan | 428/313.9 |
| 4,701,370 | 10/1987 | Park | 428/314.4 |
| 5,084,334 | 1/1992 | Hamano et al. | 428/304.4 |
| 5,141,685 | 8/1992 | Maier et al. | 264/45.3 |
| 5,143,765 | 9/1992 | Maier et al. | 428/36.5 |
| 5,223,383 | 6/1993 | Maier et al. | 430/533 |
| 5,275,854 | 1/1994 | Maier et al. | 428/36.5 |
| 5,422,175 | 6/1995 | Ito et al. | 428/304.4 |
| 5,853,965 | 12/1998 | Haydock et al. | 430/536 |
| 5,866,282 | 2/1999 | Bourdelais et al. | 430/536 |
| 5,874,205 | 2/1999 | Bourdelais et al. | 430/536 |

FOREIGN PATENT DOCUMENTS

| | | |
|---|---|---|
| 0 470 760 A2 | 2/1992 | European Pat. Off. . |
| 0 880 065 A1 | 11/1998 | European Pat. Off. . |
| 0 880 067 A1 | 11/1998 | European Pat. Off. . |
| 0 880 069 A1 | 11/1998 | European Pat. Off. . |
| 2 215 268 | 9/1989 | United Kingdom . |
| 2 325 749 | 12/1998 | United Kingdom . |
| 2 325 750 | 12/1998 | United Kingdom . |

OTHER PUBLICATIONS

Japanese Abstract 85/31669 w/claims Jul. 1985.
Japanese Abstract 5,057,836, Mar. 1993.
Japanese Abstract 7,137,216, w/claim May 1995.

*Primary Examiner*—Richard L. Schilling
*Attorney, Agent, or Firm*—Paul A. Leipold

[57] ABSTRACT

A photographic member comprising a polymer sheet comprising at least one layer of voided polyester polymer and at least one layer comprising polyethylene polymer, wherein said at least one polyethylene polymer layer comprises tints and wherein the imaging member has a percent transmission of less than 15%.

19 Claims, No Drawings

REFLECTIVE PHOTOGRAPHIC DISPLAY MATERIAL WITH VOIDED POLYESTER LAYER

FIELD OF THE INVENTION

This invention relates to photographic materials. In a preferred form it relates to base materials for photographic reflection display.

BACKGROUND OF THE INVENTION

It is known in the art that photographic display materials are utilized for advertising, as well as decorative displays of photographic images. Since these display materials are used in advertising, the image quality of the display material is critical in expressing the quality message of the product or service being advertised. Further, a photographic display image needs to be high impact, as it attempts to draw consumer attention to the display material and the desired message being conveyed. Typical applications for display material include product and service advertising in public places such as airports, buses and sports stadiums, movie posters, and fine art photography. The desired attributes of a quality, high impact photographic display material are a slight blue density minimum, durability, sharpness, and flatness. Cost is also important, as display materials tend to be expensive compared with alternative display material technology, mainly lithographic images on paper. For display materials, traditional color paper is undesirable, as it suffers from a lack of durability for the handling, photographic processing, and display of large format images.

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult requiring great care and expense to ensure proper laydown and cooling of the polyethylene layers. The formation of a suitably smooth surface would also improve image quality as the display material would have more apparent blackness as the reflective properties of the improved base are more specular than the prior materials. As the whites are whiter and the blacks are blacker, there is more range in between and, therefore, contrast is enhanced. It would be desirable if a more reliable and improved surface could be formed at less expense.

Prior art photographic reflective papers comprise a melt extruded polyethylene layer which also serves as a carrier layer for optical brightener and other whitener materials as well as tint materials. It would be desirable if the optical brightener, whitener materials and tints, rather than being dispersed throughout the single layer of polyethylene could be concentrated nearer the surface of the layer where they would be more effective optically.

Prior art photographic reflective display materials have light sensitive silver halide emulsions coated directly onto a gelatin coated opacified polyester base sheet. Since the emulsion does not contain any materials to opacify the imaging element, white pigments such as $BaSO_4$ have been added to the polyester base sheet to provide a imaging element with both opacity and the desired reflection properties. Also, optical brightener is added to the polyester base sheet to give the sheet a blue tint in the presence of a ultraviolet light source. The addition of the white pigments into the polyester sheet causes several manufacturing problems which can either reduce manufacturing efficiency or reduce image quality. The addition of white pigment to the polyester base causes manufacturing problems such as die lines and pigment agglomeration which reduce the efficiency at which photographic display material can be manufactured. It would be desirable if the optical brightener, whitener materials and tints, rather than being dispersed throughout the polyester base sheet could be concentrated nearer the surface where they would be more effective optically and improve manufacturing efficiency.

Prior art reflective photographic materials with a polyester base use a $TiO_2$ pigmented polyester base onto which light sensitive silver halide emulsions are coated. It has been proposed in WO 94/04961 to use a opaque polyester containing 10% to 25% $TiO_2$ for a photographic support. The $TiO_2$ in the polyester gives the reflective display materials an undesirable opulence appearance. The $TiO_2$ pigmented polyester also is expensive because the $TiO_2$ must be dispersed into the entire thickness, typically from 100 to 180 $\mu$m. The also gives the polyester support a slight yellow tint which is undesirable for a photographic display material. For use as a photographic display material, the polyester support containing $TiO_2$ must be tinted blue to offset the yellow tint of the polyester causing a loss in desirable whiteness and adding cost to the display material. It would be desirable if a reflective display support did not contain any $TiO_2$ in the base and $TiO_2$ could be concentrated near the light sensitive emulsion.

Prior art photographic display material use polyester as a base for the support. Typically the polyester support is from 150 to 250 $\mu$m thick to provide the required stiffness. A thinner base material would be lower in cost and allow for roll handling efficiency as the rolls would weigh less and be smaller in diameter. It would be desirable to use a base material that had the required stiffness but was thinner to reduce cost and improve roll handling efficiency.

PROBLEM TO BE SOLVED BY THE INVENTION

There is a need for a reflective display material having a whiter appearance. There is also a need for reflective display materials that have a wider color gamut and lower cost.

SUMMARY OF THE INVENTION

It is an object of the invention to overcome disadvantages of prior display materials.

It is another object to provide reflective display materials having a wider contrast range.

It is a further object to provide lower cost, high quality reflective display materials.

These and other objects of the invention are accomplished by a photographic member comprising a polymer sheet comprising at least one layer of voided polyester polymer and at least one layer comprising polyethylene polymer, wherein said at least one polyethylene polymer layer comprises tints and wherein the imaging member has a percent transmission of less than 15%.

ADVANTAGEOUS EFFECT OF THE INVENTION

The invention provides improved display materials that provide whiter whites. The reflective display materials further provide a wider color variation and sharper images. The invention materials are lower in cost.

DETAILED DESCRIPTION OF THE INVENTION

The invention has numerous advantages over prior practices in the art. The reflective display material of the invention has a whiter white than prior materials. prior materials were somewhat yellow and had a higher minimum density as there was a large quantity of white pigment in the polymer base sheet. Typically when a large quantity of white $TiO_2$ is loaded into a transparent polymer sheet, it becomes somewhat yellowish rather than being the desired neutral reflective white. The prior art base sheet containing white pigment was required to be quite thick, both to carry the high amount of white pigment, as well as to provide the stiffness required for display materials. It has surprisingly been found that by concentrating the reflective white pigments in a layer adjacent to the silver halide imaging layer, that the sharpness and whiteness of the image improve compared to prior art reflective display materials that use a polyester base. Concentration of the white pigments also significantly reduces the amount of white pigment required to provide a quality reflective image. The ability to use less white pigments in the base materials results in a cost savings. The display material of the invention provides sharper images as they have higher accutance due to the efficient reflective layer on the upper surface of the biaxially oriented polyethylene top layer. There is a visual contrast improvement in the display material of the invention as the lower density is lower than prior product and the upper amount of density has been visually increased. The display material has a more maximum black as the reflective properties of the improved base are more specular than the prior materials. As the whites are whiter and the blacks are blacker, there is more range in between and, therefore, contrast is enhanced. These and other advantages will be apparent from the detailed description below.

The terms as used herein, "top", "upper", "emulsion side", and "face" mean the side or toward the side of the photographic member bearing the imaging layers. The terms "bottom", "lower side", and "back" mean the side or toward the side of the photographic member opposite from the side bearing the photosensitive imaging layers or developed image. The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows; $T_{RGB}=10^{-}D*100$ where D is the average of the red, green and blue Status A transmission density response measured by an X-Rite model 310 (or comparable) photographic transmission densitometer.

The layers of the coextruded polyester sheet of this invention have levels of voiding, optical brightener, and colorants adjusted to provide optimum reflection properties. The polyester sheet has a voided layer to add opacity to the base materials without the use of expensive $TiO_2$ or other white pigments. Because the polyester base is coextruded, white pigments, optical brightener and blue tints can be concentrated in a layer just below the silver halide imaging layer significantly improving image quality and reducing the amount of white pigments, optical brightener and blue tints.

The polyester sheet of this invention preferably has a coextruded integral emulsion adhesion layer. Above the voided layer, a coextruded polyethylene layer can be used with corona discharge treatment as a silver halide emulsion adhesion layer, avoiding the need for a primer coating common with polyester sheets. A polyethylene layer with corona discharge treatment is preferred because gelatin based silver halide emulsions adhere well to polyethylene without the need for primer coatings. Further, the integral polyethylene skin layer preferably also contains blue tints and optical brightener to compensate for the native yellowness of the gelatin based silver halide emulsion. The voided, oriented polyester sheet of this invention is also low in cost, as the functional layer is coextruded at the same time, avoiding the need for further processing such as lamination, priming, or extrusion coating.

The polyester utilized in the invention should have a glass transition temperature between about 50° C. and about 150° C., preferably about 60–100° C., should be orientable, and have an intrinsic viscosity of at least 0.50, preferably 0.6 to 0.9. Suitable polyesters include those produced from aromatic, aliphatic, or cyclo-aliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoiso-phthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well-known techniques, e.g., those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Polypropylene is also useful. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510.

Suitable cross-linked polymers for the microbeads used in void formation during sheet formation are polymerizable organic materials which are members selected from the group consisting of an alkenyl aromatic compound having the general formula

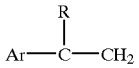

wherein Ar represents an aromatic hydrocarbon radical, or an aromatic halohydrocarbon radical of the benzene series and R is hydrogen or the methyl radical; acrylate-type monomers including monomers of the formula

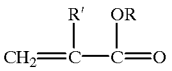

wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having the formula

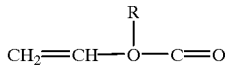

wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$, wherein n is a whole number within the range of 2–10 and having reactive olefinic linkages within the polymer molecule, the hereinabove described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, oiallyl fumarate, diallyl phthalate, and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield nonuniformly sized particles, characterized by broad particle size distributions. The resulting beads can be classified by screening to produce beads spanning the range of the original distribution of sizes. Other processes such as suspension polymerization and limited coalescence directly yield very uniformly sized particles. Suitable slip agents or lubricants include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. For example, conventional suspension polymerization processes wherein the slip agent is added to the suspension is preferred. As the slip agent, colloidal silica is preferred.

It is preferred to use the "limited coalescance" technique for producing the coated, cross-linked polymer microbeads. This process is described in detail in U.S. Pat. No. 3,615,972. Preparation of the coated microbeads for use in the present invention does not utilize a blowing agent as described in this patent, however.

The following general procedure may be utilized in a limited coalescence technique:

1. The polymerizable liquid is dispersed within an aqueous nonsolvent liquid medium to form a dispersion of droplets having sizes not larger than the size desired for the polymer globules, whereupon
2. The dispersion is allowed to rest and to reside with only mild or no agitation for a time during which a limited coalescence of the dispersed droplets takes place with the formation of a lesser number of larger droplets, such coalescence being limited due to the composition of the suspending medium, the size of the dispersed droplets thereby becoming remarkably uniform and of a desired magnitude, and
3. The uniform droplet dispersion is then stabilized by addition of thickening agents to the aqueous suspending medium, whereby the uniform-sized dispersed droplets are further protected against coalescence and are also retarded from concentrating in the dispersion due to difference in density of the disperse phase and continuous phase, and
4. The polymerizable liquid or oil phase in such stabilized dispersion is subjected to polymerization conditions and polymerized, whereby globules of polymer are obtained having spheroidal shape and remarkably uniform and desired size, which size is predetermined principally by the composition of the initial aqueous liquid suspending medium.

The diameter of the droplets of polymerizable liquid, and hence the diameter of the beads of polymer, can be varied predictably, by deliberate variation of the composition of the aqueous liquid dispersion, within the range of from about one-half of a micrometer or less to about 0.5 centimeter. For any specific operation, the range of diameters of the droplets of liquid, and hence of polymer beads, has a factor in the order of three or less as contrasted to factors of 10 or more for diameters of droplets and beads prepared by usual suspension polymerization methods employing critical agitation procedures. Since the bead size, e.g., diameter, in the present method is determined principally by the composition of the aqueous dispersion, the mechanical conditions, such as the degree of agitation, the size and design of the apparatus used, and the scale of operation, are not highly critical Furthermore, by employing the same composition, the operations can be repeated, or the scale of operations can be changed, and substantially the same results can be obtained.

The present method is carried out by dispersing one part by volume of a polymerizable liquid into at least 0.5, preferably from 0.5 to about 10 or more, parts by volume of a nonsolvent aqueous medium comprising water and at least the first of the following ingredients:

1. A water-dispersible, water-insoluble solid colloid, the particles of which, in aqueous dispersion, have dimensions in the order of from about 0.008 to about 50 vm, which particles tend to gather at the liquid-liquid interface or are caused to do so by the presence of
2. A water-soluble "promotor" that affects the "hydrophilic-hydrophobic balance" of the solid colloid particles; and/or
3. An electrolyte; and/or
4. Colloid-active modifiers such as peptizing agents, surface-active agents and the like; and usually,
5. A water-soluble, monomer-insoluble inhibitor of polymerization.

The water-dispersible, water-insoluble solid colloids can be inorganic materials such as metal salts or hydroxides or clays, or can be organic materials such as raw starches, sulfonated cross-linked organic high polymers, resinous polymers, and the like.

The solid colloidal material must be insoluble but dispersible in water and both insoluble and nondispersible in, but wettable by, the polymerizable liquid. The solid colloids must be much more hydrophilic than oleophilic so as to remain dispersed wholly within the aqueous liquid. The solid colloids employed for limited coalescence are ones having particles that, in the aqueous liquid, retain a relatively rigid and discrete shape and size within the limits stated. The particles may be greatly swollen and extensively hydrated, provided that the swollen particle retains a definite shape, in which case the effective size is approximately that of the swollen particle. The particles can be essentially single molecules, as in the case of extremely high molecular weight cross-linked resins, or can be aggregates of many molecules. Materials that disperse in water to form true or colloidal solutions in which the particles have a size below the range stated or in which the particles are so diffuse as to lack a discernible shape and dimension are not suitable as stabilizers for limited coalescence. The amount of solid colloid that is employed is usually such as corresponds to from about 0.01 to about 10 or more grams per 100 cubic centimeters of the polymerizable liquid.

In order to function as a stabilizer for the limited coalescence of the polymerizable liquid droplets, it is essential that the solid colloid must tend to collect with the aqueous liquid at the liquid-liquid interface, i.e., on the surface of the oil droplets. (The term "oil" is occasionally used herein as generic to liquids that are insoluble in water.) In many instances, it is desirable to add a "promoter" material to the aqueous composition to drive the particles of the solid colloid to the liquid-liquid interface. This phenomenon is well known in the emulsion art, and is here applied to solid colloidal particles, as an expanded of adjusting the "hydrophilic-hydrophobic balance."

Usually, the promoters are organic materials that have an affinity for the solid colloid and also for the oil droplets and that are capable of making the solid colloid more oleophilic. The affinity for the oil surface is usually due to some organic portion of the promoter molecule, while affinity for the solid colloid is usually due to opposite electrical charges. For example, positively charged complex metal salts or hydroxides, such as aluminum hydroxide, can be promoted by the presence of negatively charged organic promoters such as water-soluble sulfonated polystyrenes, alignates, and carboxymethylcellulose. Negatively charged colloids, such as Bentonite, are promoted by positively charged promoters such as tetramethyl ammonium hydroxide or chloride or water-soluble complex resinous amine condensation products, such as the water-soluble condensation products of diethanolamine and adipic acid, the water-soluble condensation products of ethylene oxide, urea and formaldehyde, and polyethylenimine. Amphoteric materials such as proteinaceous materials like gelatin, glue, casein, albumin, glutin and the like are effective promoters for a wide variety of colloidal solids. Nonionic materials like methoxycellulose are also effective in some instances. Usually, the promoter need be used only to the extent of a few parts per million of aqueous medium, although larger proportions can often be tolerated. In some instances, ionic materials normally classed as emulsifiers, such as soaps, long chain sulfates and sulfonates and the long chain quaternary ammonium compounds, can also be used as promoters for the solid colloids, but care must be taken to avoid causing the formation of stable colloidal emulsions of the polymerizable liquid and the aqueous liquid medium.

An effect similar to that of organic promoters is often obtained with small amounts of electrolytes, e.g., water-soluble, ionizable alkalies, acids and salts, particularly those having polyvalent ions. These are especially useful when the excessive hydrophilic or insufficient oleophilic characteristic of the colloid is attributable to excessive hydration of the colloid structure. For example, a suitably cross-linked sulfonated polymer of styrene is tremendously swollen and hydrated in water. Although the molecular structure contains benzene rings which should confer on the colloid some affinity for the oil phase in the dispersion, the great degree of hydration causes the colloidal particles to be enveloped in a cloud of associated water. The addition of a soluble, ionizable polyvalent cationic compound, such as an aluminum or calcium salt, to the aqueous composition causes extensive shrinking of the swollen colloid with exudation of a part of the associated water and exposure of the organic portion of the colloid particle, thereby making the colloid more oleophilic.

The solid colloidal particles whose hydrophilic-hydrophobic balance is such that the particles tend to gather in the aqueous phase at the oil-water interface, gather on the surface of the oil droplets and function as protective agents during limited coalescence.

Other agents that can be employed in an already known manner to effect modification of the colloidal properties of the aqueous composition are those materials known in the art as peptizing agents, flocculating and deflocculating agents, sensitizers, surface active agents, and the like.

It is sometimes desirable to add to the aqueous liquid a few parts per million of a water-soluble, oil-insoluble inhibitor of polymerization effective to prevent the polymerization of monomer molecules that might diffuse into the aqueous liquid or that might be absorbed by colloid micelles and that, if allowed to polymerize in the aqueous phase, would tend to make emulsion-type polymer dispersions instead of, or in addition to, the desired bead or pearl polymers.

The aqueous medium containing the water-dispersible solid colloid is then admixed with the liquid polymerizable material in such a way as to disperse the liquid polymerizable material as small droplets within the aqueous medium. This dispersion can be accomplished by any usual means, e.g., by mechanical stirrers or shakers, by pumping through jets, by impingement, or by other procedures causing subdivision of the polymerizable material into droplets in a continuous aqueous medium.

The degree of dispersion, e.g., by agitation is not critical except that the size of the dispersed liquid droplets must be no larger, and is preferably much smaller, than the stable droplet size expected and desired in the stable dispersion. When such condition has been attained, the resulting dispersion is allowed to rest with only mild, gentle movement, if any, and preferably without agitation. Under such quiescent conditions, the dispersed liquid phase undergoes a limited degree of coalescence.

"Limited coalescence" is a phenomenon wherein droplets of liquid dispersed in certain aqueous suspending media coalesce, with formation of a lesser number of larger droplets, until the growing droplets reach a certain critical and limiting size, whereupon coalescence substantially ceases. The resulting droplets of dispersed liquid, which can be as large as 0.3 and sometimes 0.5 centimeter in diameter, are quite stable as regards further coalescence and are remarkably uniform in size. If such a large droplet dispersion be vigorously agitated, the droplets are fragmented into smaller droplets. The fragmented droplets, upon quiescent standing, again coalesce to the same limited degree and form the same uniform-sized, large droplet, stable dispersion. Thus, a dispersion resulting from the limited coalescence comprises droplets of substantially uniform diameter that are stable in respect to further coalescence.

The principles underlying this phenomenon have now been adapted to cause the occurrence of limited coalescence in a deliberate and predictable manner in the preparation of dispersions of polymerizable liquids in the form of droplets of uniform and desired size.

In the phenomenon of limited coalescence, the small particles of solid colloid tend to collect with the aqueous liquid at the liquid-liquid interface, i.e., on the surface of the oil droplets. It is thought that droplets which are substantially covered by such solid colloid are stable to coalescence while droplets which are not so covered are not stable. In a given dispersion of a polymerizable liquid the total surface area of the droplets is a function of the total volume of the liquid and the diameter of the droplets. Similarly, the total surface area barely coverable by the solid colloid, e.g., in a layer one particle thick, is a function of the amount of the colloid and the dimensions of the particles thereof. In the dispersion as initially prepared, e.g., by agitation, the total surface area of the polymerizable liquid droplets is greater than can be covered by the solid colloid. Under quiescent conditions, the unstable droplets begin to coalesce. The coalescence results in a decrease in the number of oil droplets and a decrease in the total surface area thereof up to a point at which the amount of colloidal solid is barely sufficient substantially to cover the total surface of the oil droplets, whereupon coalescence substantially ceases.

If the solid colloidal particles do not have nearly identical dimensions, the average effective dimension can be estimated by statistical methods. For example, the average effective diameter of spherical particles can be computed as the square root of the average of the squares of the actual diameters of the particles in a representative sample.

It is usually beneficial to treat the uniform droplet suspension prepared as described above to render the suspension stable against congregation of the oil droplets.

This further stabilization is accomplished by gently admixing with the uniform droplet dispersion an agent capable of greatly increasing the viscosity of the aqueous liquid. For this purpose, there may be used any water-soluble or water-dispersible thickening agent that is insoluble in the oil droplets and that does not remove the layer of solid colloidal particles covering the surface of the oil droplets at the oil-water interface. Examples of suitable thickening agents are sulfonated polystyrene (water-dispersible, thickening grade), hydrophilic clays such as Bentonite, digested starch, natural gums, carboxy-substituted cellulose ethers, and the like. Often the thickening agent is selected and employed in such quantities as to form a thixotropic gel in which are suspended the uniform-sized droplets of the oil. In other words, the thickened liquid generally should be non-Newtonian in its fluid behavior, i.e., of such a nature as to prevent rapid movement of the dispersed droplets within the aqueous liquid by the action of gravitational force due to the difference in density of the phases. The stress exerted on the surrounding medium by a suspended droplet is not sufficient to cause rapid movement of the droplet within such non-Newtonian media. Usually, the thickener agents are employed in such proportions relative to the aqueous liquid that the apparent viscosity of the thickened aqueous liquid is in the order of at least 500 centipoises (usually determined by means of a Brookfield viscosimeter using the No. 2 spindle at 30 r.p.m.). The thickening agent is preferably prepared as a separate concentrated aqueous composition that is then carefully blended with the oil droplet dispersion.

The resulting thickened dispersion is capable of being handled, e.g., passed through pipes, and can be subjected to polymerization conditions substantially without mechanical change in the size or shape of the dispersed oil droplets.

The resulting dispersions are particularly well suited for use in continuous polymerization procedures that can be carried out in coils, tubes, and elongated vessels adapted for continuously introducing the thickened dispersions into one end and for continuously withdrawing the mass of polymer beads from the other end. The polymerization step is also practiced in batch manner.

The order of the addition of the constituents to the polymerization usually is not critical, but beneficially it is more convenient to add to a vessel the water, dispersing agent, and incorporated the oil-soluble catalyst to the monomer mixture, and subsequently add with agitation the monomer phase to the water phase.

The following is an example illustrating a procedure for preparing the cross-linked polymeric microbeads coated with slip agent. In this example, the polymer is polystyrene cross-linked with divinylbenzene. The microbeads have a coating of silica. The microbeads are prepared by a procedure in which monomer droplets containing an initiator are sized and heated to give solid polymer spheres of the same size as the monomer droplets. A water phase is prepared by combining 7 liters of distilled water, 1.5 g potassium dichromate (polymerization inhibitor for the aqueous phase), 250 g polymethylaminoethanol adipate (promoter), and 350 g LUDOX (a colloidal suspension containing 50% silica sold by DuPont). A monomer phase is prepared by combining 3317 g styrene, 1421 g divinylbenzene (55% active cross-lining agent; other 45% is ethyl vinyl benzene which forms part of the styrene polymer chain) and 45 g VAZO 52 (a monomer-soluble initiator sold by DuPont). The mixture is passed through a homogenizer to obtain 5 micrometer droplets. The suspension is heated overnight at 52° C. to give 4.3 kg of generally spherical microbeads having an average diameter of about 5 $\mu$m with narrow size distribution (about 2–10 $\mu$m size distribution). The mol proportion of styrene and ethyl vinyl benzene to divinylbenzene is about 6.1%. The concentration of divinylbenzene can be adjusted up or down to result in about 2.5–50% (preferably 10–40%) cross-linking by the active cross-linker. Of course, monomers other than styrene and divinylbenzene can be used in similar suspension polymerization processes known in the art. Also, other initiators and promoters may be used as known in the art. Also, slip agents other than silica may also be used. For example, a number of LUDOX colloidal silicas are available from DuPont. LEPANDIN colloidal alumina is available from Degussa. NALCOAG colloidal silicas are available from Nalco, and tin oxide and titanium oxide are also available from Nalco.

Normally, for the polymer to have suitable physical properties such as resiliency, the polymer is cross-linked. In the case of styrene cross-linked with divinylbenzene, the polymer is 2.5–50% cross-linked, preferably 20–40% cross-linked. By percent cross-linked, it is meant the mol % of cross-lining agent based on the amount of primary monomer. Such limited cross-linking produces microbeads which are sufficiently coherent to remain intact during orientation of the continuous polymer. Beads of such cross-linking are also resilient, so that when they are deformed (flattened) during orientation by pressure from the matrix polymer on opposite sides of the microbeads, they subsequently resume their normal spherical shape to produce the largest possible voids around the microbeads to thereby produce articles with less density.

The microbeads are referred to herein as having a coating of a "slip agent". By this term it is meant that the friction at the surface of the microbeads is greatly reduced. Actually, it is believed this is caused by the silica acting as miniature ball bearings at the surface. Slip agent may be formed on the surface of the microbeads during their formation by including it in the suspension polymerization mix.

Microbead size is regulated by the ratio of silica to monomer. For example, the following ratios produce the indicated size microbead:

| Microbead Size, μm | Monomer. Parts by Wt. | Slip Agent (Silica) Parts by Wt. |
|---|---|---|
| 2 | 10.4 | 1 |
| 5 | 27.0 | 1 |
| 20 | 42.4 | 1 |

The microbeads of cross-linked polymer range in size from 0.1–50 μm, and are present in an amount of 5–50% by weight based on the weight of the polyester. Microbeads of polystyrene should have a Tg of at least 20° C. higher than the Tg of the continuous matrix polymer and are hard compared to the continuous matrix polymer.

Elasticity and resiliency of the microbeads generally result in increased voiding, and it is preferred to have the Tg of the microbeads as high above that of the matrix polymer as possible to avoid deformation during orientation. It is not believed that there is a practical advantage to cross-linking above the point of resiliency and elasticity of the microbeads.

The microbeads of cross-linked polymer are at least partially bordered by voids. The void space in the supports should occupy 2–60%, preferably 30–50%, by volume of the film support. Depending on the manner in which the supports are made, the voids may completely encircle the microbeads, e.g., a void may be in the shape of a doughnut (or flattened doughnut) encircling a micro-bead, or the voids may only partially border the microbeads, e.g., a pair of voids may border a microbead on opposite sides.

During stretching the voids assume characteristic shapes from the balanced biaxial orientation of paperlike films to the uniaxial orientation of microvoided/satinlike fibers. Balanced microvoids are largely circular in the plane of orientation, while fiber microvoids are elongated in the direction of the fiber axis. The size of the microvoids and the ultimate physical properties depend upon the degree and balance of the orientation, temperature and rate of stretching, crystallization kinetics, the size distribution of the microbeads, and the like.

The film supports according to this invention are prepared by:

(a) forming a mixture of molten continuous matrixpolymer and cross-linked polymer wherein the cross-linked polymer is a multiplicity of microbeads uniformly dispersed throughout the matrix polymer, the matrix polymer being as described hereinbefore, the cross-linked polymer microbeads being as described hereinbefore, (b) forming a film support from the mixture by extrusion or casting, (c) orienting the article by stretching to form microbeads of cross-linked polymer uniformly distributed throughout the article and voids at least partially bordering the microbeads on sides thereof in the direction, or directions of orientation.

The mixture may be formed by forming a melt of the matrix polymer and mixing therein the cross-linked polymer. The cross-linked polymer may be in the form of solid or semisolid microbeads. Due to the incompatibility between the matrix polymer and cross-linked polymer, there is no attraction or adhesion between them, and they become uniformly dispersed in the matrix polymer upon mixing.

When the microbeads have become uniformly dispersed in the matrix polymer, a film support is formed by processes such as extrusion or casting. Examples of extrusion or casting would be extruding or casting a film or sheet. Such forming methods are well known in the art. If sheets or film material are cast or extruded, it is important that such article be oriented by stretching, at least in one direction. Methods of unilaterally or bilaterally orienting sheet or film material are well known in the art. Basically, such methods comprise stretching the sheet or film at least in the machine or longitudinal direction after it is cast or extruded an amount of about 1.5–10 times its original dimension. Such sheet or film may also be stretched in the transverse or cross-machine direction by apparatus and methods well known in the art, in amounts of generally 1.5–10 (usually 3–4 for polyesters and 6–10 for polypropylene) times the original dimension. Such apparatus and methods are well known in the art and are described in such U.S. Pat. No. 3,903,234.

The voids, or void spaces, referred to herein surrounding the microbeads are formed as the continuous matrix polymer is stretched at a temperature above the Tg of the matrix polymer. The microbeads of cross-linked polymer are relatively hard compared to the continuous matrix polymer. Also, due to the incompatibility and immiscibility between the microbead and the matrix polymer, the continuous matrix polymer slides over the microbeads as it is stretched, causing voids to be formed at the sides in the direction or directions of stretch, which voids elongate as the matrix polymer continues to be stretched. Thus, the final size and shape of the voids depends on the direction(s) and amount of stretching. If stretching is only in one direction, microvoids will form at the sides of the microbeads in the direction of stretching. If stretching is in two directions (bidirectional stretching), in effect such stretching has vector components extending radially from any given position to result in a doughnut-shaped void surrounding each microbead.

The preferred preform stretching operation simultaneously opens the microvoids and orients the matrix material. The final product properties depend on and can be controlled by stretching time-temperature relationships and on the type and degree of stretch. For maximum opacity and texture, the stretching is done just above the glass transition temperature of the matrix polymer. When stretching is done in the neighborhood of the higher glass transition temperature, both phases may stretch together and opacity decreases. In the former case, the materials are pulled apart, a mechanical anticompatibilization process. Two examples are high-speed melt spinning of fibers and melt blowing of fibers and films to form nonwoven/spun-bonded products. In summary, the scope of this invention includes the complete range of forming operations just described.

In general, void formation occurs independent of, and does not require, crystalline orientation of the matrix polymer. Opaque, microvoided films have been made in accordance with the methods of this invention using completely amorphous, noncrystallizing copolyesters as the matrix phase. Crystallizable/orientable (strain hardening) matrix materials are preferred for some properties like tensile strength and gas transmission barrier. On the other hand, amorphous matrix materials have special utility in other areas like tear resistance and heat sealability. The specific matrix composition can be tailored to meet many product needs. The complete range from crystalline to amorphous matrix polymer is part of the invention.

The preferred spectral transmission of the biaxially oriented polyolefin sheet of this invention is less than 15% and most preferably about 0%. Spectral transmission is the amount of light energy that is transmitted through a material. For a photographic element, spectral transmission is the ratio of the transmitted power to the incident power and is expressed as a percentage as follows: $T_{RGB}=10^{-D}*100$ where D is the average of the red, green and blue Status A transmission density response measured by an X-Rite model 310 (or comparable) photographic transmission densitometer. The higher the transmission, the less opaque the material. For a reflective display material, the quality of the image is related to the amount of light reflected from the image to the observer's eye. A reflective image with a high amount of spectral transmission does not allow sufficient light to reach the observer's eye causing a perceptual loss in image quality. A reflective image with a spectral transmission of greater than 20% is unacceptable for a reflective display material as the quality of the image can not match prior art reflective display materials.

A reflection density of greater than 85% for the biaxially oriented sheet of this invention is preferred. The reflection density may be anywhere between greater than 85% and 100%. Reflection density is the amount of light energy reflecting from the image to an observer's eye. Reflection density is measured by 0°/45° geometry Status A red/green/blue response using an X-Rite model 310 (or comparable) photographic transmission densitometer. A sufficient amount of reflective light energy is required to give the perception of image quality. A reflection density less than 75% is unacceptable for a reflective display material and does not match the quality of prior art reflective display materials.

The photographic member of the invention has a preferred thickness of between 76 μm and 256 μm. Below 70 μm, the base does not have sufficient stiffness to allow for efficient processing of the image, as the invention must be transported through photographic printers, processors, and finishing equipment. Above 270 μm, there is not sufficient justification for the additional expense for additional polymer materials. Orientation of the polyester base is preferred, as an oriented polymer is stiffer and stronger than a nonoriented polymer, thus the required photographic member stiffness can be obtained with the use of less material compared to a nonoriented polyester.

The preferred thickness of the top polyethylene layer is between 0.75 and 7.0 micrometers. Below 0.50 micrometers, the layer is difficult to form during orientation and undesirable voids can appear on the surface. Above 10 micrometers, the polyethylene layer with white pigments, blue tint and optical brightener begin to loose optical efficiency reducing image sharpness and image whiteness.

The surface roughness of the topside determines the reflective characteristics of the image. Surface roughness for the topside and the bottom side are measured by TAYLOR-HOBSON Surtronic 3 with 2 μm diameter ball tip. The output Ra or "roughness average" from the TAYLOR-HOBSON is in units of micrometers and has a built-in, cutoff filter to reject all sizes above 0.25 mm. For the top surface, a surface roughness of between 0.02 and 0.25 μm is preferred because this roughness range creates a glossy surface that has commercial value, as most reflection display materials are glossy in nature.

For some markets, a matte surface on the reflection display material is desirable. Prior art reflection display materials require post processing treatment of the image with a separate coating to create a matte surface. Surface roughness for the reflective display materials of the invention is integral with the coextruded support using known techniques for creating a rough surface. Example of surface roughness techniques include the addition of addenda such as silica or calcium carbonate to the surface layer and embossing the surface after the sheet has been oriented. For a matte surface appearance, a surface roughness of between 0.30 and 2.00 μm is preferred. A surface roughness less than 0.25 is considered glossy. A surface roughness greater than 2.25 caused the light sensitive silver halide emulsion to puddle and create an undesirable discontinuous surface. Further, a surface roughness greater than 2.25 μm has been shown to emboss the light sensitive silver halide emulsion when the reflection display material is wound in a roll.

Addenda may be added to any coextruded layer in the polymer sheet to change the color of the imaging element. For photographic display use, a white base with a slight bluish tinge is preferred. Further, the native yellowness of the gelatin based silver halide emulsion must be corrected with blue tints because a yellow density minimum area is unsatisfactory. The addition of the slight bluish tinge may be accomplished by any process which is known in the art including the machine blending of color concentrate prior to extrusion and the melt extrusion of blue colorants that have been preblended at the desired blend ratio. Colored pigments that can resist extrusion temperatures greater than 320° C. are preferred, as temperatures greater than 320° C. are necessary for coextrusion of the polymer layers. Blue colorants used in this invention may be any colorant that does not have an adverse impact on the imaging element. Preferred blue colorants include Phthalocyanine blue pigments, Cromophtal blue pigments, Irgazin blue pigments, Irgalite organic blue pigments, and pigment blue 60.

Addenda may be added to the polymer sheet of this invention so that when the biaxially oriented sheet is viewed from a surface, the imaging element emits light in the visible spectrum when exposed to ultraviolet radiation. Emission of light in the visible spectrum allows for the support to have a desired background color in the presence of ultraviolet energy. This is particularly useful when images are viewed outside, as sunlight contains ultraviolet energy and may be used to optimize image quality for consumer and commercial applications.

Addenda known in the art to emit visible light in the blue spectrum are preferred. Consumers generally prefer a slight blue tint to a minimum density area of an image defined as a negative b* compared to a neutral density minimum defined as a b* within one b* unit of zero. b* is the measure of yellow/blue in CIE space. A positive b* indicates yellow, while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is an illuminated ultraviolet light source and a light source without any significant ultraviolet energy. Delta b* is the preferred measure to determine the net effect of adding an optical brightener to the top biaxially oriented sheet of this invention. Emissions less than 1 b* unit cannot be noticed by most customers; therefore, is it not cost effective to add optical brightener to the polymer layers because it will not make a perceptual difference. An emission greater that 5 b* units would interfere with the color balance of the prints making the whites appear too blue for most consumers.

The surface roughness of the polymer sheet of this invention or Ra is a measure of relatively finely spaced surface irregularities such as those produced on the backside of photographic materials by the casting of polyethylene against a rough chilled roll. The surface roughness measurement is a measure of the maximum allowable roughness height expressed in units of micrometers and by use of the symbol Ra. For the irregular profile of the backside of photographic materials of this invention, the average peak to valley height, which is the average of the vertical distances between the elevation of the highest peak and that of the lowest valley, is used.

Oriented polyester sheets commonly used in the photographic industry are commonly melt extruded and then oriented in both directions (machine direction and cross direction) to give the sheet desired mechanical strength properties. The process of biaxially orientation generally creates a surface roughness of less than 0.23 μm. While the smooth surface has value in the photographic industry for use as a glossy surface, a smooth surface on the backside can cause conveyance problems during photographic processing of images. For efficient web conveyance during photographic processing, a surface roughness greater than 0.30 μm is preferred to ensure efficient transport through the many types of photographic processing equipment that have been purchased and installed around the world. At surface roughness less that 0.30 μm, transport through the photographic processing equipment becomes less efficient. At surface roughness greater than 2.54 μm, the surface would become too rough causing transport problems in photographic processing equipment and the rough backside surface would begin to emboss the silver halide emulsion as the material is wound in rolls.

In order to successfully transport display materials of the invention, the reduction of static caused by web transport through manufacturing and image processing is desirable. Since the light sensitive imaging layers of this invention can be fogged by light from a static discharge accumulated by the web as it moves over conveyance equipment such as rollers and drive nips, the reduction of static is necessary to avoid undesirable static fog. The polymer materials of this invention have a marked tendency to accumulate static charge as they contact machine components during transport. The use of an antistatic material to reduce the accumulated charge on the web materials of this invention is desirable. Antistatic materials may be coated on the web materials of this invention and may contain any known materials known in the art which can be coated on photographic web materials to reduce static during the transport of photographic paper. Examples of antistatic coatings include conductive salts and colloidal silica. Desirable antistatic properties of the support materials of this invention may also be accomplished by antistatic additives which are an integral part of the polymer layer. Incorporation silica. Desirable antistatic properties of the support materials of this invention may also be accomplished by antistatic additives which are an integral part of the polymer layer. Incorporation of additives that migrate to the surface of the polymer to improve electrical conductivity include fatty quaternary ammonium compounds, fatty amines, and phosphate esters. Other types of antistatic additives are hydroscopic compounds such as polyethylene glycols and hydrophobic slip additives that reduce the coefficient of friction of the web materials. An antistatic coating applied to the opposite side of the image layer or incorporated into the backside polymer layer is preferred. The backside is preferred because the majority of the web contact during conveyance in manufacturing and photoprocessing is on the backside. The preferred surface resistivity of the antistat coat at 50% RH is less than $10^{11}$ ohm/square. A surface resistivity of the antistat coat at 50% RH is less than $10^{11}$ ohn/square has been shown to sufficiently reduce static fog in manufacturing and during photographic printing and development of the image layers.

The polyester film will typically contain an undercoat or primer layer on both sides of the polyester film. Subbing layers used to promote adhesion of coating compositions to the support are well known in the art and any such material can be employed. Some useful compositions for this purpose include interpolymers of vinylidene chloride such as vinylidene chloride/methyl acrylate/itaconic acid terpolymers or vinylidene chloride/acrylonitrile/acrylic acid terpolymers, and the like. These and other suitable compositions are described, for example, in U.S. Pat. Nos. 2,627,088; 2,698,240; 2,943,937; 3,143,421; 3,201,249; 3,271,178; 3,443,950; and 3,501,301. The polymeric subbing layer is usually overcoated with a second subbing layer comprised of gelatin, typically referred to as gel sub. The preferred primer coating is a layer comprised of gelatin because gelatin based silver halide silver halide emulsions adhere well to gelatin.

The structure of a preferred integral oriented, voided polyester photographic base where the light sensitive silver halide emulsion is coated on the tinted polyethylene layer is as follows:

| |
|---|
| Polyethylene with blue tint, 18% anatase $TiO_2$ and optical brightener |
| Voided polyester |

As used herein, the phrase "photographic element" or "imaging element" is a material that utilizes photosensitive silver halide in the formation of images. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11), and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

The elements of the invention may use materials as disclosed in *Research Disclosure*, 40145, September 1997, particularly the couplers as disclosed in Section II of the Research Disclosure.

In the following Table, reference will be made to (1) *Research Disclosure*, December 1978, Item 17643, (2) *Research Disclosure*, December 1989, Item 308119, and (3) *Research Disclosure*, September 1994, Item 36544, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation |
| 3 | I, II, III, IX A & B | including hardeners, coating aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | |
| 2 | VI | Antifoggants and stabilizers |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | |
| 2 | XVII | Supports |

-continued

| Reference | Section | Subject Matter |
|---|---|---|
| 3 | XV | |
| 3 | XI | Specific layer arrangements |
| 3 | XII, XIII | Negative working emulsions; |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements.

The following examples illustrate the practice of this invention. They are not intended to be exhaustive of all possible variations of the invention. Parts and percentages are by weight unless otherwise indicated.

EXAMPLES

Example 1

In this example a coextruded voided, oriented polyester base material was coated with a typical color light sensitive silver halide emulsion. The polyester base had blue tint and optical brightener added to the polyethylene layer to correct for the native yellowness of the gelatin based imaging layers used. The invention also utilized the polyethylene layer to provide adequate emulsion adhesion. The invention was compared to Kodak Duraflex (Eastman Kodak Co.) is a one side color silver halide coated polyester support (256 $\mu$m thick) containing $BaSO_4$ and optical brightener. This example will show that the reflection display image for the invention is superior to the prior art materials for image quality parameters critical for reflection display images. Further, several manufacturing advantages resulting in a lower cost material will be obvious.

The following is the layer structure and materials for the voided polyester base:

Top Layer (Emulsion side):

A layer of low density polyethylene with a layer thickness of 4.0 $\mu$m. The polyethylene layer contained 0.12% by weight of optical brightener, 20% by weight of $TiO_2$ and 0.05% by weight of a blue tint. The optical brightener used was Hostalux KS manufactured by Ciba-Geigy. The rutile $TiO_2$ used was DuPont R104 (a 0.22 micrometer particle size $TiO_2$). The blue tint used was Pigment Blue 60.

Middle Layer:

A layer of mircovoided polyester (polyethylene terephthalate) comprising polyester and microbeads with a layer thickness of 100 $\mu$m and a percent voiding of 50%. The voiding agent was a cross-linked microbead of polystyrene with divinylbenzene in the amount of 50% by weight of said layer. The mean particle size of the microbead was between 1 to 2 $\mu$m and were coated with a slip agent of colloidal alumina. To this layer pigment blue 60 and Hostalux KS (Ciba-Geigy) optical brightener were added to offset the yellowness of the gelatin based emulsion. The 0.30% by weight of pigment blue 60 and 0.12% by weight of optical brightener was added to the voided polyester layer.

Bottom Layer:

The bottom layer of the coextruded support was a solid layer of polyester that was 50 $\mu$m thick. The polyester has an intrinsic viscosity of at about 0.68 cp.

The top, middle, and bottom layers were coextruded through a standard three slot coat hanger die at 265° C. onto a chill roll controlled at a temperature between 50–60° C. The three layer film was stretched biaxially using a standard laboratory film stretching unit at a temperature of 105° C.

The preparation steps for the cross-linked microbeads used to void the middle layer of the coextruded support were as follows:

(1) The microbeads were prepared by conventional aqueous suspension polymerization to give nearly mono-disperse bead diameters from 2 to 20 $\mu$m and at levels of cross-linking from 5 mol % to 30 mol %.

(2) After separation and drying, the microbeads were compounded on conventional twin-screw extrusion equipment into the polyester at level of 25% by weight and pelletized to form a concentrate, suitable for let-down to lower loadings.

(3) The microbead concentrate pellets were mixed with virgin pellets and dried using standard conditions for polyethylene terephthalate, 170–180° C. convection with desiccated air for between 4–6 hours.

Coating format 1 was utilized to prepare the reflection display material of the invention and was coated on the polyethylene skin layer which was corona discharge treat at 30 joules/$m^2$.

| | Coating Format 1 | Laydown mg/$m^2$ |
|---|---|---|
| Layer 1 | Blue Sensitive | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive | |
| | Gelatin | 1100 |
| | Green sensitive | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |
| Layer 6 | UV Overcoat | |
| | Gelatin | 440 |
| | UV-1 | 20 |

-continued

| | Coating Format 1 | Laydown mg/m$^2$ |
|---|---|---|
| | UV-2 | 110 |
| | SC-1 | 30 |
| | S-3 | 20 |
| | S-1 | 20 |
| Layer 7 | SOC | |
| | Gelatin | 490 |
| | SC-1 | 17 |
| | $SiO_2$ | 200 |
| | Surfactant | 2 |

APPENDIX

Y-1

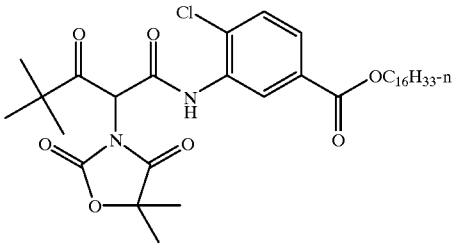

ST-1 = N-tert-butylacrylamide/n-butyl acrylate copolymer (50:50)

S-1 = dibutyl phthalate

SC-1

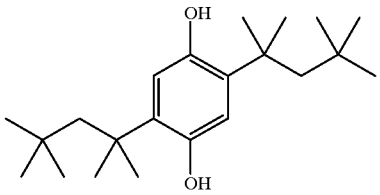

M-1

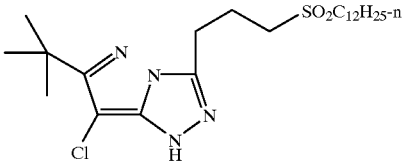

S-2 = diundecyl phthalate

ST-2

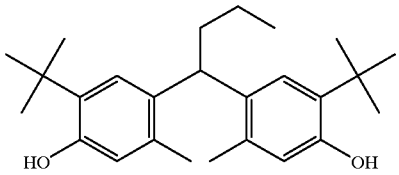

ST-3

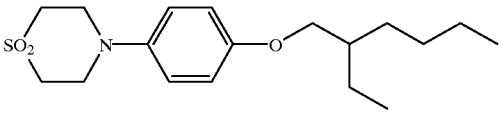

ST-4

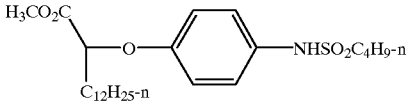

-continued

UV-1

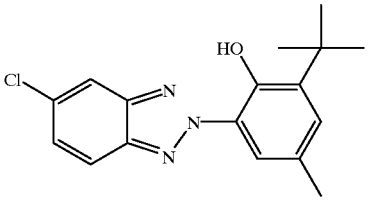

UV-2

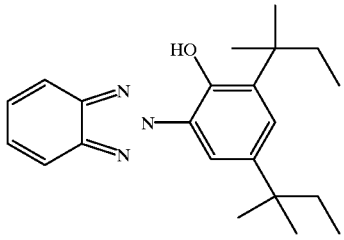

S-3 = 1,4-Cyclohexyldimethylene bis(2-ethylhexanoate)

C-1

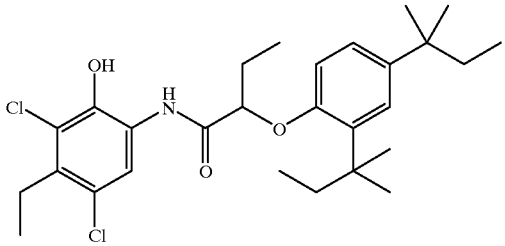

S-4 = 2-(2-Butoxyethoxy)ethyl acetate

Dye 1

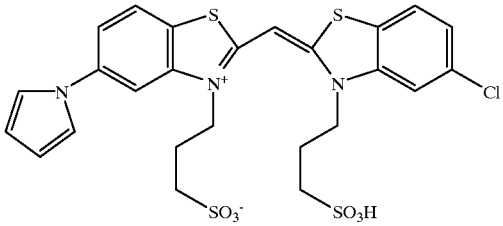

The structure of photographic reflective display material of the example was the following:

| |
|---|
| Coating Format 1 |
| Polyethylene skin layer with $TiO_2$, blue tint and optical brightener |
| Voided polyester |
| Transparent polyester |

The display materials (both invention and control) were processed as a minimum density. The display support was measured for status A density using an X-Rite Model 310 photographic densitometer. Spectral transmission is calculated from the Status A density readings and is the ratio of the transmitted power to the incident power and is expressed as a percentage as follows; $T_{RGB}=10^{-D}*100$ where D is the average of the red, green, and blue Status A transmission density response. The display materials were also measured for L*, a*, and b* using a Spectrogard spectrophotometer, CIE system, using illuminant D6500. The comparison data for invention and control are listed in Table 1 below.

TABLE 1

| Measure | Invention | Control |
|---|---|---|
| % Transmission | 2.2 | 2.6 |
| CIE D6500 L* | 96.2 | 95.6 |
| CIE D6500 a* | −0.04 | −0.82 |
| CIE D6500 b* | −1.31 | 2.2 |
| Thickness | 150 micrometers | 225 micrometers |

The reflective display support coated on the top side with the light sensitive silver halide coating format of this example exhibits all the properties needed for an photographic reflective display material. Further the photographic reflective display material of this example has many advantages over prior art photographic reflective display materials. The thin polyethylene layer had levels of optical brightener and colorants adjusted to provide an improved minimum density position compared to prior art reflection display materials as the invention was able to overcome the native yellowness of the processed emulsion layers (b* for the invention was −1.31 compared to the b* of 2.2 for the control reflection material). For reflective display materials, a neutral density minimum defined as a* and b* that is within one unit of zero measured in CIE space is more perceptually preferred than a yellow density minimum creating a higher quality image for the invention compared to the control material.

The 2.2% transmission for the invention provides a superior reflection image, as the invention has excellent opacity to prevent ambient light from interfering with the image. The a* and L* for the invention are consistent with a high quality reflection display materials. Finally the invention would be lower in cost over prior art materials, as the $TiO_2$ optical brightener and blue tint was concentrated in a thin polyethylene layer compared to prior art materials which have white pigments and optical brightener dispersed in a thick polyester base. Additionally The use of a primer coat used for prior art reflection display materials that use a polyester base was avoided as the integral polyethylene skin provided excellent emulsion adhesion.

The invention has been described in detail with particular reference to certain preferred embodiments thereof, but it will be understood that variations and modifications can be effected within the spirit and scope of the invention.

What is claimed is:

1. A photographic imaging member comprising a coextruded integral polymer sheet comprising at least one layer of voided polyester polymer and at least one layer comprising polyethylene polymer, wherein said at least one polyethylene polymer layer comprises tints and wherein the imaging member has a percent transmission of less than 15%.

2. The photographic imaging member of claim 1 wherein said polymer sheet is oriented.

3. The photographic imaging member of claim 1 wherein said polymer sheet comprises a back and a front polyethylene layer.

4. The photographic imaging member of claim 1 wherein said member further comprises at least one subbing layer.

5. The photographic imaging member of claim 1 wherein said void space comprises between about 2 and 60% by volume of said polymer sheet.

6. The photographic imaging member of claim 1 wherein said photographic imaging member has a thickness of between 76 and 256 $\mu$m.

7. The photographic imaging member of claim 1 wherein said tints comprise bluing tints.

8. The photographic imaging member of claim 1 wherein said polymer sheet comprises optical brighteners.

9. The photographic imaging member of claim 1 wherein said polymer sheet comprises $TiO_2$.

10. The photographic imaging member of claim 1 wherein said polymer sheet comprises pigments selected from the group consisting of barium sulfate, clay, talc, $TiO_2$ and zinc oxide.

11. The photographic imaging member of claim 1 further comprising a top layer comprising a photosensitive silver halide and a dye forming coupler.

12. The photographic imaging member of claim 1 wherein said polyethylene polymer layer has a thickness between 0.75 and 7.0 micrometers.

13. The photographic imaging member of claim 1 wherein at least one layer below said polyethylene containing layer comprises a charge control agent having an electrical resistivity of less than $10^{11}$ log-ohms per square.

14. The photographic imaging member of claim 1 wherein said voided layer contains organic particles that are the voiding initiating material for said voided layer.

15. The photographic imaging member of claim 1 wherein the back of said imaging member has a surface roughness of between 0.3 and 2.0 $\mu$m.

16. The photographic imaging member of claim 7 wherein the top of said imaging member has a surface roughness of between 0.02 and 0.25 micrometers.

17. The photographic imaging number of claim 7 where said polymer sheet is biaxally oriented.

18. The photographic imaging number of claim 1 where said polymer sheet is biaxally oriented.

19. The photographic member of claim 7 further comprising at least one layer comprising photo sensitive silver halide and dye forming coupler.

* * * * *